United States Patent [19]

Hicks

[11] 4,392,358

[45] Jul. 12, 1983

[54] APPARATUS AND METHOD OF DETECTING FAILURE IN A REFRIGERATOR DEFROST SYSTEM

[75] Inventor: Frederick E. Hicks, Louisville, Ky.

[73] Assignee: General Electric Company, Louisville, Ky.

[21] Appl. No.: 278,302

[22] Filed: Jun. 29, 1981

[51] Int. Cl.[3] ..... F25D 21/06

[52] U.S. Cl. ..... 62/155; 62/234; 62/80; 62/128

[58] Field of Search ..... 62/155, 157, 158, 234, 62/128, 80

[56] References Cited

U.S. PATENT DOCUMENTS

| | | | |
|---|---|---|---|
| 1,730,366 | 10/1929 | Hartwig . | |
| 3,147,466 | 9/1964 | Stacy | 340/252 |
| 3,354,254 | 11/1967 | Jackson et al. | 13/9 |
| 3,394,559 | 7/1968 | Jones | 62/276 |
| 3,521,264 | 7/1970 | Limon | 340/253 |
| 3,736,765 | 6/1973 | O'Dell | 62/127 |
| 3,774,189 | 11/1973 | Brown | 340/253 |
| 4,066,870 | 1/1978 | Colten | 219/528 |
| 4,101,190 | 7/1978 | Schoff | 339/113 |
| 4,142,374 | 3/1979 | Ansted et al. | 62/155 |
| 4,156,350 | 5/1979 | Elliott et al. | 62/80 |
| 4,327,557 | 5/1982 | Clarke et al. | 62/155 |

*Primary Examiner*—Albert J. Makay
*Assistant Examiner*—Henry Bennett
*Attorney, Agent, or Firm*—Frederick P. Weidner; Radford M. Reams

[57] ABSTRACT

A defrost system for refrigerating apparatus having a refrigerating mode and a defrosting mode including an evaporator and an electric resistance heater in heat transfer relationship with the evaporator. There is provided a timer to actuate a normally open defrost initiation switch to energize the heater periodically and initiate a defrosting mode. A defrost terminating thermostat switch is in the heater circuit and will open at a predetermined elevated temperature to deenergize the heater and close at a lower temperature. A voltage sensor across the normally open defrost initiation switch senses periodically and provides a signal when voltage in the heater circuit is interrupted. The multiple voltage sensor signals are stored in a memory bank over a predetermined period of time and when the voltage is interrupted for the predetermined period of time, an alarm is actuated to indicate failure of the defrost system.

6 Claims, 5 Drawing Figures

APPARATUS AND METHOD OF DETECTING FAILURE IN A REFRIGERATOR DEFROST SYSTEM

BACKGROUND OF THE INVENTION

This invention relates to apparatus and the method of detecting failure of a defrost system for refrigerating apparatus.

Automatic defrosting systems for refrigerating apparatus have been utilized for a long time wherein periodically some form of heat usually from an electric resistance heater is utilized to remove accumulated frost buildup on the refrigerating apparatus evaporator. The normal operation of refrigerating apparatus would include some kind of timer device which would operate to provide the refrigerating mode operation for a period of time and then terminate the refrigerating mode and initiate a defrosting mode wherein the electric resistance heater is energized causing it to heat up and radiate heat to the evaporator for a period of time sufficient to melt the built-up frost on the evaporator. When the frost has been removed from the evaporator, a defrost terminating thermostat in thermal relationship with the evaporator senses a rise in temperature and at some predetermined elevated temperature opens to terminate the defrost operation. An example of such an automatic defrost system is disclosed in U.S. Pat. No. 3,394,5519 and also in U.S. Pat. No. 4,156,350 both of which are assigned to the same assignee as the present invention.

In the event that the defrost system becomes inoperative, the result is accumulated buildup of frost on the evaporator to such an extent that poor cooling performance of the refrigerating system results. It is desirable in refrigerating apparatus having automatic defrost systems that should there be a failure of the defrost system that there be some kind of early alarm signal to alert the user that the defrost system is inoperative and should be repaired.

Detection of failure in electrical circuits by having indicator lights come on when there is a break in the circuit has been known for years and such signal arrangements are shown in U.S. Pat. Nos. 1,730,366 and 3,147,466. These signal arrangements, however, provide for a signal only when there is a break in the circuit. In present refrigerator defrost systems, there is an intentional break in the circuit provided when the defrost terminating thermostat switch opens to deenergize the heater and stop the defrosting mode. There is, therefore, a need for providing failure detection in a refrigerating apparatus defrost system wherein a break in the circuit does intentionally occur periodically, however, an alarm signal would only be actuated when there is an unintentional break in the circuit that persists over a relatively long period of time.

SUMMARY OF THE INVENTION

According to one aspect of this invention, there is provided apparatus and method for detecting failure in an automatic defrost system for refrigerating apparatus having a refrigerating mode and a defrosting mode and including an evaporator and an electric resistance heater in heat transfer relationship with the evaporator. There is provided a timer to actuate a normally open defrost initiation switch to energize the heater periodically and initiate the defrosting mode. A defrost terminating thermostat switch will open at a predetermined elevated temperature to deenergize the heater and close at a lower temperature. A voltage sensor across the normally open defrost initiation switch is utilized to sense periodically and provide a signal when voltage in the heater circuit is interupted. Memory means for receiving and storing multiple voltage sensor signals over a predetermined period of time is provided. Alarm means are utilized to indicate when the voltage in the heater circuit is interrupted for the predetermined period of time thereby indicating to the user that the defrost system is inoperative.

DESCRIPTION OF THE PREFERRED EMBODIMENT

Figure 1:
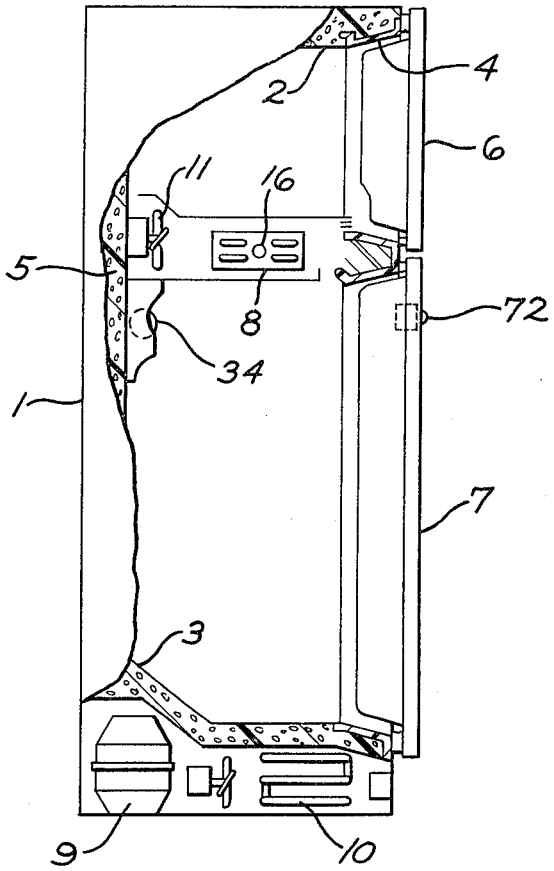
FIG. 1 is a side elevational view, partly in section, of refrigerating apparatus such as a household refrigerator embodying one form of the present invention.

With reference to FIG. 1 of the drawing, there is illustrated a refrigerator cabinet including an outer case 1, an upper inner liner 2 defining a freezer storage compartment, and a lower inner liner 3 defining a fresh food storage compartment. The forward edges of both liners are spaced from the forward edges of the case and these spaces are bridged by heat insulating breaker strips 4, while the spaces between the liners in the outer case are filled with suitable thermal insulating material 5. The access openings to the freezer and fresh food compartments are respectively closed by gasketed doors 6 and 7.

Refrigeration for the two compartments is provided by an evaporator 8 positioned in the partition between the two compartments which forms part of the refrigeration system including an electric motor-driven compressor 9 and a condenser 10. A fan 11 rearwardly from evaporator 8 provides means for circulating air from the two compartments over the evaporator 8 and back into the compartments.

A thermostatic control means generally indicated by the numeral 34 including a temperature sensing means is provided for automatically controlling the operation of the compressor 9 to maintain the temperature within the fresh food compartment within a controlled range. Also, in accordance with the usual practice, this thermostatic control means can be manually adjusted for the desired temperature in the fresh food compartment and also it can be moved to an "off" position whereby the compressor 9 is deenergized regardless of the temperatures within the cabinet.

Evaporator 8 operates at temperatures below freezing and for the purpose of periodically removing accumulated frost from the evaporator surfaces, there is provided an electrical defrost heater 16 in heat transfer relationship with the evaporator, which is periodically energized by operation of a defrost control timer 32, which may be located in housing 17.

Figure 2:
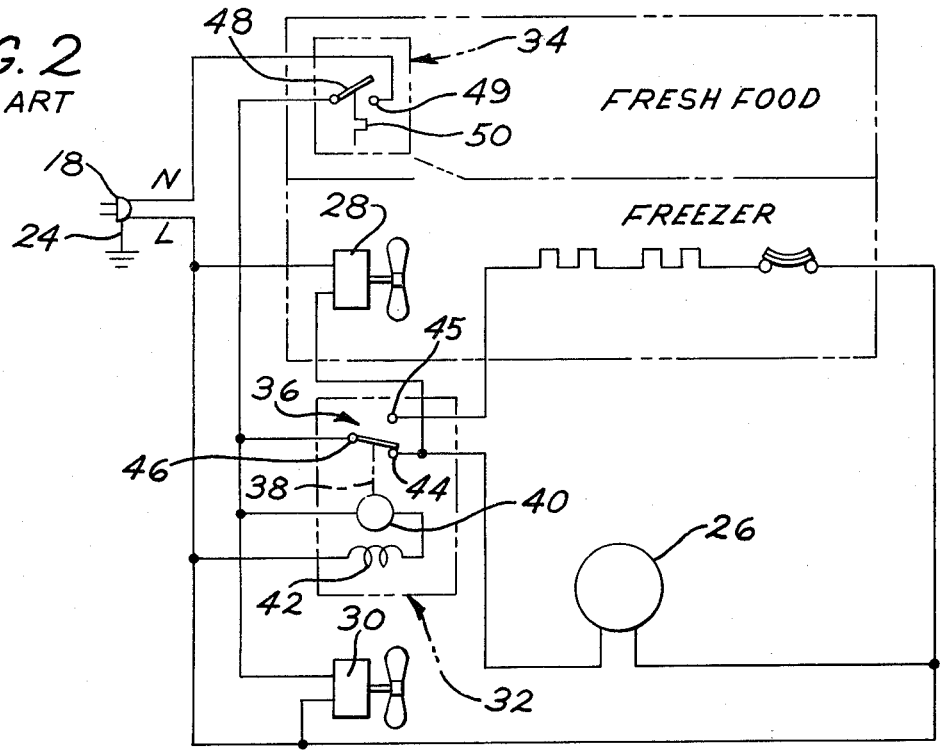
FIG. 2 PRIOR ART
FIG. 2 is a diagramatic view of a prior art refrigerating and defrosting circuit.

The control circuitry and components for controlling the refrigerating and defrost operations of a prior art refrigerator is illustrated in FIG. 2 of the drawing. A conventional power plug 18 supplies L and N supply conductors 20 and 22, and has a connection 24 to ground the frame of the refrigerator. The refrigeration system includes a compressor motor 26 and an evaporator fan motor 28 connected in parallel. The refrigeration system further includes a condenser fan and motor 30 for forced-air cooling of the condenser 10. For controlled operation of the refrigeration system, the compressor and evaporator fan motors 26 and 28 are connected to the L supply conductor 20 through a defrost control timer 32 and through the thermostatic control means 34 for controlling the interior temperature of the refrigerator. The compressor, evaporator fan and condenser fan motors 26 28 and 30 each have return electrical connections to the N supply conductor 22. The defrost control timer 32 includes a cam-operated, single-pole double-throw switch 36 operated through a link 38 by a defrost control cam 40 driven by a timing motor 42. When the defrost control switch 36 and the cam 40 are in the cooling position shown, the compressor and evaporator fan motors 26 and 28 are connected through the switch terminals 44 and 46 and through the thermostatic control means 34 to the L supply conductor 20.

The particular thermostatic control means 34 includes a temperature sensing means or thermostat 48 which is a conventional hydraulic type normally employed in refrigerators, and includes a remote temperature sensing bulb, represented by an element 50 at the end of a small-diameter tube. The thermostat 48 has a range of adjustment for the normal fresh food compartment temperature which setting is normally between 33° F. and 43° F., with 38° F. being a nominal setting. It will be understood that the tenperature sensing means 48 operates independently of the defrost control timer 32.

In the operation of the prior art circuitry shown in FIG. 2, thusfar described, the thermostat 48 is enabled to cycle the compressor motor 26, the evaporator fan motor 28 and the condenser fan motor 30 as required to maintain the temperature in the refrigerated compartment. Each time the enabled thermostat 48 closes, power is supplied through contact 49 along a conductor to the defrost control timing motor 42 to rotate the defrost control cam 40. In order to initiate the automatic defrosting mode, the timing of the motor speed and cam arrangement are typically such that after every 5½ hours of timing motor running time, the cam 40 switches the defrost control switch 36 from switch terminal 44 to the upper position making contact with switch terminal 45 thus deenergizing the compressor and evaporator fan motors 26 and 28, and energizing the defrost heater 54. The defrost control switch 36 remains in the upper position for a period of approximately 30 minutes. The N return for the defrost heater 54 is connected through a defrost terminating bimetallic switch 56 which is adjusted to open at approximately 50° F. Under normal frost loading conditions, the evaporator is completely defrosted and the bimetallic switch 56 opens within the 30 minute defrost duration period determined by the defrost control cam 40 and the defrost control timing motor 42.

Figure 3:
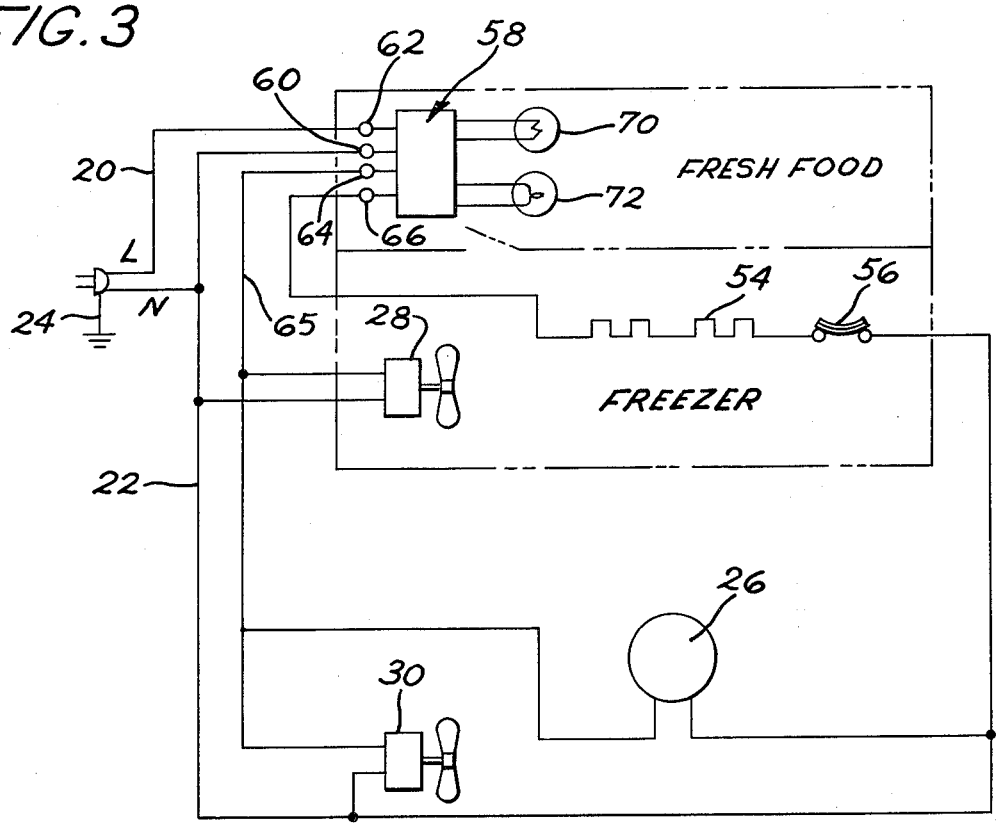
FIG. 3 is a diagramatic view of one form of the refrigerating and defrosting circuit incorporating the present invention including a control module.
Figure 4:
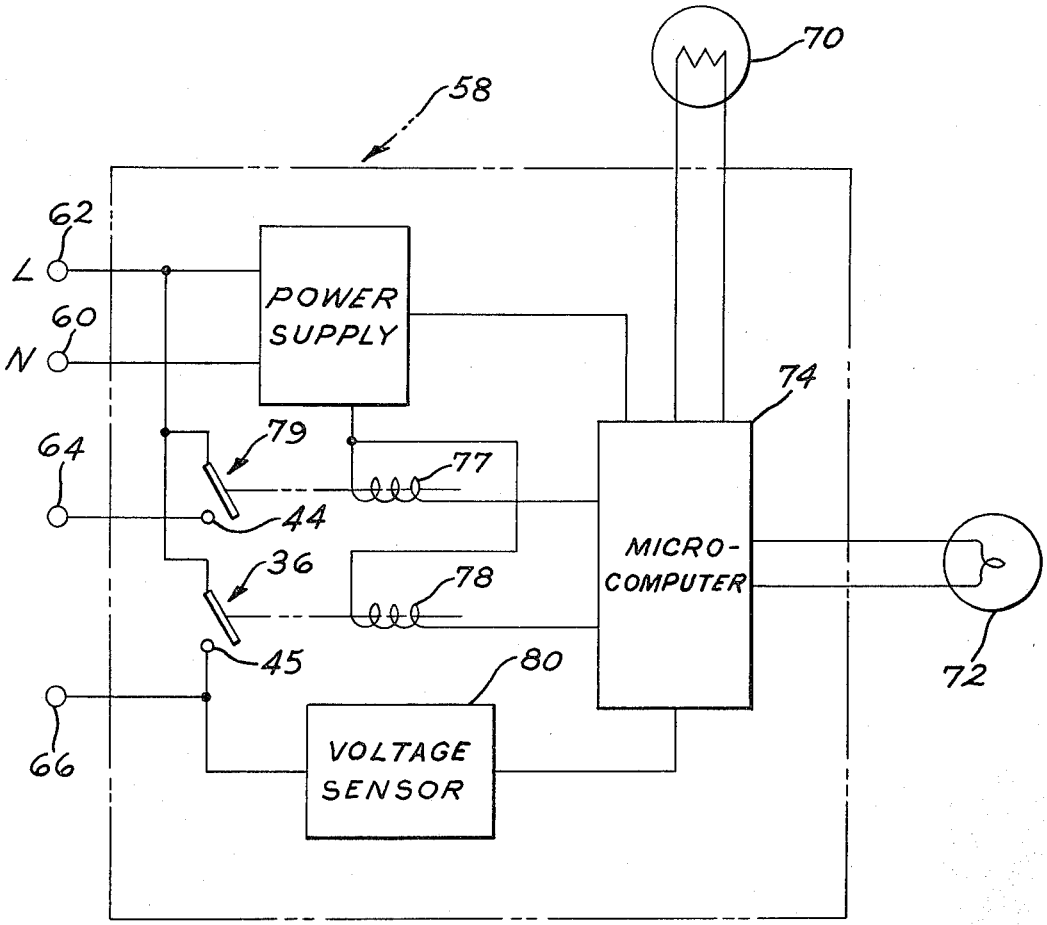
FIG. 4 is an enlarged view showing components of the control module shown in FIG. 3.

With reference to FIGS. 3 and 4, the apparatus and method of this invention for detecting failure in the defrost system will now be discussed. The circuit arrangement in FIG. 3 is somewhat similar to that shown as the prior art circuit in FIG. 2 and many of the elements are numbered identically. A conventional power plug 18 supplies L and N supply conductors 20 and 22, and has a connection 24 to ground the frame of the refrigerator. The refrigeration system includes a compressor motor 26 and an evaporator fan motor 28 connected in parallel. The refrigeration system likewise includes a condenser fan and motor 30 for forced-air cooling of the condenser 10. The compressor, evaporator fan and condenser fan motors 26, 28, and 30 each have return electrical connections to the N supply conductor 22. There is a control module 58 having connection junction 60 for line N, connection junction 62 for line L, connection junction 64 for conductor 65 leading to the compressor, evaporator fan and condenser fan motors 26, 28, and 30, and connection junction 66 connecting conductor 68 to the defrost heater 54. Electrically connected to the control module 58 is a temperature sensor 70 and an alarm light 72.

FIG. 4 is a diagramatic view of the components of the control module 58 and the temperature sensor 70 and alarm light 72. A microcomputer 74 is utilized to perform several functions for the refrigerating apparatus one of which is to control the operation of the compressor, evaporator fan and condenser fan notors 26, 28, and 30 for the refrigerating mode in response to input signals from the temperature sensor calling or not calling for the cooling operation of the system. The function of the microcomputer 74 in this invention is to assist in detecting a break or long-time interruption in the defrost heater circuit and actuate the alarm light 72 by an output signal. The microcomputer 74 may comprise a self-contained integrated circuit such as a Mostek MK3870 including an arithmetic logic circuit, appropriate memory registers and input/output circuits as is well known in the art. Microcomputer 74, in part, is pre-programmed to be adapted to serve as a decision and timer means for this invention as will be discussed later. Microcomputers such as the one utilized in this invention operate on low voltage, therefore, a power supply or transformer 76 provides the appropriate voltage to the microcomputer 74 from the conventional 60 hertz, 120 volt household power source, with lines N and L entering the power supply 76 via connection junctions 60 and 62, respectively. The microcomputer 74 functions as an electronic timer using either RC or digital counter timing elements and performs the same function for the defrosting mode as the defrost control timer 32 previously discussed in connection with the prior art circuit shown in FIG. 2. That is, after a preselected period of refrigerating time, such as 5½ hours, an output signal from the microcomputer 74 de-energizes relay 77 that removes power to the compressor through terminal 44 of switch 79 thus terminating the refrigerating operation. Simultaneously, another output signal from the microcomputer 74 actuates relay 78 which closes switch 36 and applies power to the defrost heater 54 through terminal 45. The defrost mode will continue for a preselected time, say 30 minutes pre-programmed into the microcomputer 74, or a shorter period if the accumulated frost is removed and the resultant elevated temperature opens the defrost thermostat 56.

By my invention, a voltage sensor 80 is connected across the normally open defrost initiation switch 36 to sense periodically, say every 15 minutes, and provide a signal to the microcomputer 74 when voltage in the defrost heater circuit is interrupted. The microcomputer 74 receives and stores in its memory bank multiple voltage sensor signals over a predetermined period of time. The microcomputer 74 is pre-programmed so that if the signals from the voltage sensor 80 indicates that the voltage is interrupted for the entire predetermined period of time, an output signal from the microcomputer 74 will set an alarm, such as by energizing the alarm light 72. One aspect of this invention in detecting failure of the defrost system is that means are provided to not indicate a failure when the defrost terminating thermostat 56 opens to terminate the defrost mode because the failure must persist for the predetermined period of time which is substantially longer than the period of time the defrost terminating thermostat switch is open. For instance, if the defrost terminating thermostat switch is designed to stay open about 30 minutes, then the predetermined period of time programmed into the microcomputer 74 may be an hour.

Figure 5:
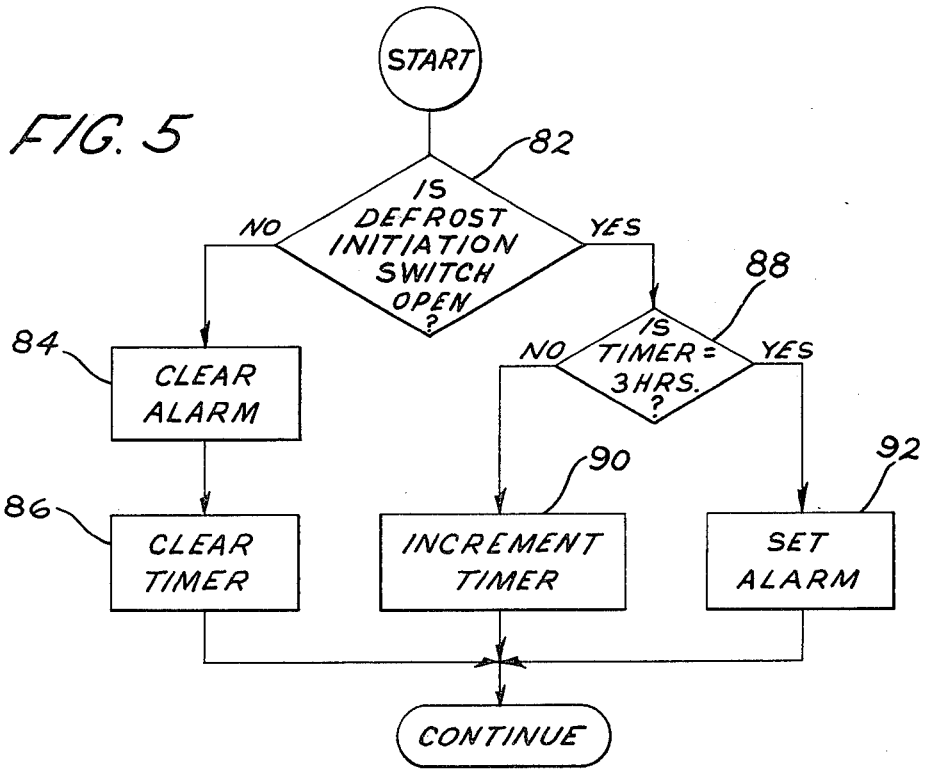
FIG. 5 is a program flow diagram which may be employed in developing a program for the present invention.

Referring now to FIG. 5, a program flow chart is shown which may be used by those skilled in the art to establish a set of program instructions for microcomputer 74 to accomplish the invention. It will be appreciated that the illustrated flow chart may represent only a portion of a complete program for the microcomputer 74 by which other functions of the refrigerator may also be controlled. The program starts and inquiry 82 determines whether the normally open defrost initiation switch 36 is open or not. If the answer is no, instruction 84 will clear the alarm, such as turn off the alarm light 72, and instruction 86 will also clear the timer of any accumulated time registered for the predetermined period of time programmed into the microcomputer 74. If inquiry 82 determines that normally open defrost initiation switch 36 is open indicating the refrigerating apparatus is in the refrigerating mode, the program moves to inquiry 88 and asks if the defrost circuit has been open for at least the entire predetermined period of time which in the program flow chart is three hours. If the answer is no, the instruction 90 is to increment the timer. That is, add 15 minutes to the accumulated time registered for the predetermined period of time since the voltage sensor 80 is pulsed every 15 minutes. The system then continues to run. If the answer to inquiry 88 is yes, indicating the defrost circuit has been open for at least three hours, instruction 92 will set the alarm by an output signal from the microcomputer 74 to energize the alarm light 72. The system will then continue to rum. If the defect in the defrost circuit is not corrected, the repeat program will continue to keep the alarm light energized. If the defect is corrected, the repeat program will clear the alarm by instruction 84 and clear the timer by instruction 86.

It should be apparent to those skilled in the art that the embodiment described above is considered to be the presently preferred form of this invention. In accordance with the Patent Statutes, changes may be made in the disclosed apparatus and the manner in which it is used without actually departing from the true spirit and scope of this invention.

I claim:

1. The method of detecting defrost circuit failure in a refrigerating system having a refrigerating mode and a defrosting mode including an evaporator with an electric resistance heater in heat transfer relationship with the evaporator comprising:

energizing the heater periodically to initiate the defrost mode by actuating a normally open defrost initiation switch responsive to a timer, de-energizing the heater responsive to a normally closed defrost terminating thermostat switch opening at a predetermined elevated temperature, periodically sensing for voltage across the normally open defrost initiation switch and generating a signal when voltage in the heater circuit is interrupted, storing the multiple voltage signals generated in a memory bank over a predetermined period of time, clearing the memory bank each time the defrost terminating thermostat switch closes, and actuating an alarm when the voltage in the heater circuit is interrupted for the predetermined period of time.

2. The method of detecting defrost circuit failure in a refrigerating system according to claim 1 including storing the multiple voltage signals for a predetermined period of time substantially longer than the period of time the defrost terminating thermostat switch remains open.

3. The method of detecting defrost circuit failure in a refrigerating system according to claim 1 including actuating an alarm by completing an electrical circuit to a visual signal light to energize it.

4. A defrost system for refrigerating apparatus having a refrigerating mode and a defrosting mode and including an evaporator and an electric resistance heater in heat transfer relationship with the evaporator comprising:

a timer to actuate a normally open defrost initiation switch to periodically energize the heater and initiate a defrost mode, a defrost terminating thermostat switch that will open at a predetermined elevated temperature to de-energize the heater and close at a lower temperature, a voltage sensor connected across the normally open defrost initiation switch to sense periodically and provide a signal when voltage in the heater circuit is interrupted, memory means for receiving and storing multiple voltage sensor signals over a predetermined period of time, means to clear the memory means each time the defrost terminating thermostat switch closes, and alarm means to indicate when the voltage in the heater circuit is interrupted for the predetermined period of time.

5. The defrost system of claim 4 wherein the predetermined period of time for receiving and storing multiple voltage sensor signals is substantially longer than the period the defrost terminating thermostat switch is open.

6. The defrost system of claim 4 wherein the alarm means is a visual signal light.

* * * * *